US009255743B2

(12) United States Patent
Lee et al.

(10) Patent No.: US 9,255,743 B2
(45) Date of Patent: Feb. 9, 2016

(54) FINNED HEAT DISSIPATION MODULE

(75) Inventors: Ke-chin Lee, Taiwan (CN); Shu-Lung Chung, Taiwan (CN); Hung-Chieh Chen, Taiwan (TW)

(73) Assignee: Zhongshan WeiQiang Technology Co., Ltd., Zhongshan, Guangdong (CN)

( * ) Notice: Subject to any disclaimer, the term of this patent is extended or adjusted under 35 U.S.C. 154(b) by 1010 days.

(21) Appl. No.: 13/184,835

(22) Filed: Jul. 18, 2011

(65) Prior Publication Data

US 2012/0080176 A1 Apr. 5, 2012

(30) Foreign Application Priority Data

Sep. 30, 2010 (CN) ..... 2010 1 0504597
Dec. 18, 2010 (CN) ..... 2010 1 0594151

(51) Int. Cl.

| | |
|---|---|
| ***F28D 15/00*** | (2006.01) |
| ***F28D 15/02*** | (2006.01) |
| ***F28D 15/04*** | (2006.01) |
| ***F21V 29/00*** | (2015.01) |
| ***F21V 29/70*** | (2015.01) |
| ***F21V 29/74*** | (2015.01) |
| ***F21V 29/77*** | (2015.01) |
| *F28F 1/20* | (2006.01) |
| *F21Y 101/02* | (2006.01) |

(52) U.S. Cl.

CPC ..... *F28D 15/0233* (2013.01); *F21V 29/2212* (2013.01); *F21V 29/70* (2015.01); *F21V 29/74* (2015.01); *F21V 29/773* (2015.01); *F28D 15/0275* (2013.01); *F28D 15/046* (2013.01); *F21Y 2101/02* (2013.01); *F28F 1/20* (2013.01)

(58) Field of Classification Search

CPC ..... F28D 15/0233; F28D 15/0275
USPC ..... 165/80.3, 104.33
See application file for complete search history.

(56) References Cited

U.S. PATENT DOCUMENTS

| | | | | |
|---|---|---|---|---|
| 3,714,981 | A * | 2/1973 | Noren | 165/47 |
| 4,145,708 | A * | 3/1979 | Ferro et al. | 257/715 |
| 5,412,535 | A * | 5/1995 | Chao et al. | 361/700 |
| 6,439,298 | B1 * | 8/2002 | Li | 165/104.33 |
| 6,994,152 | B2 | 2/2006 | Rosenfeld | 165/104.21 |

(Continued)

FOREIGN PATENT DOCUMENTS

| | | | |
|---|---|---|---|
| CN | 201382395 | Y | 1/2010 |
| CN | 201382395 | Y * | 1/2010 |

(Continued)

*Primary Examiner* — Marc Norman
*Assistant Examiner* — Devon Russell
(74) *Attorney, Agent, or Firm* — Andrew W. Chu; Craft Chu PLLC

(57) ABSTRACT

A high-power heat dissipation module for cooling down electronic components comprises a heat exchange element with a sealed cavity, in which a powder sintering portion and a working liquid is provided. The heat exchange element further has a flat section for mounting the electronic component, and a fixing structure. The heat dissipation module further comprises a heat sink with a central hole portion and a heat dissipation structure around the central hole portion. The heat generated by the electronic component is transferred to the heat sink by the heat exchange element, and then quickly dissipated into the air surrounding by the heat dissipation structure. The heat dissipation modules can handle the heat dissipation task for the electronic components with a power of 100 Watts or more and are suitable for cooling high-power electronic components.

11 Claims, 10 Drawing Sheets

(56) References Cited

U.S. PATENT DOCUMENTS

| | | | | |
|---|---|---|---|---|
| 7,142,422 | B2 * | 11/2006 | Lee et al. | 361/695 |
| 7,269,013 | B2 * | 9/2007 | Chen et al. | 361/700 |
| 7,333,336 | B2 * | 2/2008 | Kim | 361/709 |
| 7,423,879 | B2 * | 9/2008 | Chang | 361/704 |
| 7,499,280 | B2 * | 3/2009 | Otsuki et al. | 361/704 |
| 7,543,960 | B2 | 6/2009 | Chang | 362/294 |
| 7,610,947 | B2 * | 11/2009 | Wang et al. | 165/80.3 |
| 8,381,800 | B2 * | 2/2013 | Ma et al. | 165/80.3 |
| 8,777,462 | B2 * | 7/2014 | Wu et al. | 362/373 |
| 2004/0108104 | A1 * | 6/2004 | Luo | 165/181 |
| 2007/0079954 | A1 * | 4/2007 | Wang et al. | 165/104.26 |
| 2008/0285271 | A1 | 11/2008 | Roberge | 362/235 |
| 2009/0147520 | A1 * | 6/2009 | Liu et al. | 362/294 |
| 2010/0006268 | A1 * | 1/2010 | Meyer et al. | 165/104.26 |
| 2010/0084116 | A1 * | 4/2010 | Chen | 165/80.3 |
| 2010/0133553 | A1 * | 6/2010 | Meyer et al. | 257/88 |
| 2010/0134980 | A1 * | 6/2010 | Yu | 361/711 |
| 2012/0080177 | A1 | 4/2012 | Lee et al. | 165/185 |

FOREIGN PATENT DOCUMENTS

| | | | |
|---|---|---|---|
| CN | 101986775 | B | 7/2012 |
| TW | M300864 | | 5/1995 |
| TW | M369422 | U1 | 11/2009 |
| TW | 201020461 | A1 | 6/2010 |

* cited by examiner

FINNED HEAT DISSIPATION MODULE

CROSS-REFERENCE TO RELATED APPLICATIONS

This application claims the benefit and priority of Chinese Patent Application No. 201010504597.5, filed Sep. 30, 2010 and Chinese Patent Application No. 201010594151.6, filed Dec. 18, 2010. The entire disclosure of the above applications are incorporated herein by reference.

FIELD

The present disclosure relates to heat dissipation modules, and more particularly to a high-power heat dissipation module for LEDs, CPUs, GPUs, chipsets, power semiconductors or circuit boards with electronic components.

BACKGROUND

In the electronic industry, heat dissipation modules are used to cool electronic components using heat conduction. The heat dissipation modules include a fin structure, which is in contact with the electronic components for absorbing heat. The heat is transferred to the fins and then dissipated into the surrounding air by the fins. The total contact area of the fins to air significantly impacts heat dissipation efficiency of the heat dissipation module.

The basic type of heat dissipation construction described above can handle the heat dissipation of the electronic components with a power less than 100 W. For the electronic components with higher power, the heat dissipation module requires extra components, such as a fan, to accelerate the speed of air flow. Alternately other heat conduction techniques are used. However, for some high-power electronic components, such as LEDs, the lifespan of the fan is much shorter than the electronic components. Therefore, in some applications the fans fail or are damaged before the electronic components. Therefore, a reasonable design of the heat dissipation module based on the basic construction to achieve a balance of the service life between the electronic component and the heat dissipation module is desired.

SUMMARY

In order to solve the problem of insufficient heat dissipation efficiency of the fanless heat dissipation module, the present disclosure discloses a highly efficient heat dissipation module.

A heat dissipation module for cooling an electronic component includes a heat exchange element having a sealed cavity therein, in which a powder sintered portion and a gas-liquid two-phase changing working fluid are provided. The heat exchange element further includes a flat section for mounting the electronic component, and a fixing structure disposed on the back of the flat section. A heat sink includes a central hole portion therein and a heat dissipation structure around the central hole potion. The central hole portion receives and secures the fixing structure of the heat exchange element. The heat sink allows the heat generated by the electronic component to be transferred to the heat sink and then dissipated into the surrounding air.

The working fluid in the heat exchange element is gas-liquid two-phase changeable. While the temperature difference between the electronic component and the edge of the heat sink is large, the heat exchange element is able to dissipate the heat generated by the heat source to the heat sink immediately, taking heat away through the heat sink from inside to outside.

In other features, the heat dissipation structure includes a plurality of fins around the central hole portion, to form a finned heat sink. The fins are arranged around the central hole portion in a ring shape, making the heat sink have an overall circular tube shape for facilitating airflow.

In other features, the fins are flat-plate-shaped for providing a larger air contact area. Furthermore, the fins are branched on the ends thereof. A connecting wall is provided between the two adjacent fins. The connecting wall with the two adjacent fins forms a through hole for creating airflow through chimney effects by heat.

In other features, the fins are arc-shaped, thereby adding extra airflow along the bending direction of the fins while air flows. As an improvement to the above embodiment, the heat sink may be a finless heat sink, comprising at least one air channel disposed around the central hole portion, capable of creating air flow in the air channel through the chimney effect generated by the heat transferred from the electronic component.

Furthermore, a plurality of outward divergent blades are provided around the central hole portion. Every two adjacent blades are connected by an outer wall, which forms an air channel with the outer portion of the central hole portion. The blades are used as a heat conduction structure in contact with air. In addition, the blades are connected in order to form a tube-shaped outer heat dissipation structure around the central hole portion.

In other features, the outer wall is flat-plate-shaped. The outer structure of the heat sink has a polygon-tube shape with angularities consisting of a plurality of outer walls. The blades are connected to the polygon tube on the angularities.

In other features, the outer wall is flat-plate-shaped. The outer structure of the heat sink has a polygon-tube shape including a plurality of outer walls. The blades are connected to the polygon tube on the corners.

In other features, the out wall is arc-shaped. The out structure of the heat sink has circular-tube shape including a plurality of outer walls. The outer walls are connected to the inner side of the circular tube.

In other features, the heat exchange element is a vapor chamber having a flat section on the middle thereof and two press-formed inserting sections symmetrically disposed on the two ends of the flat sections as the fixing structure. Accordingly the heat sink has a couple of jacks as the central hole portion corresponding to the two inserting sections.

In other features, each inserting section of the vapor chamber has a circular-arc shape, together with the other to form a hollow-tube shape with two symmetrical gaps. Accordingly the jacks of the heat sink are arc-shaped holes matched with the two inserting sections, for better heat conductibility.

The vapor chamber further has transitional sections converging towards the axis thereof between the flat section and the inserting sections. A concave receiving chamber is provided on the end surface of the heat sink for receiving and positioning the transitional sections of the vapor chamber. The jacks are set inside the receiving chamber.

The vapor chamber has a supporting structure for shape supporting in the cavity thereof.

The jacks of the heat sink extend from the receiving chamber to the other end of the central hole portion, to provide the possibility of air flowing through the central hole portion. Accordingly, the flat section of the vapor chamber protrudes slightly from the end surface of the central hole portion of the heat sink, to preserve gaps between the sides of the flat section and the central hole portion for connecting the receiving chamber and to the jacks.

In other features, the heat exchange element may be a heat column, having a flat section on the end thereof. The cylinder part of the heat column is as the fixing structure. The central hole portion is a jack corresponding to the cylinder part of the heat column. Firmer fixation and greater heat conduction are thus achieved by the shape and heat conductivity of the heat column.

The heat column has a vacuumed cavity, of which half space is filled by the working fluid. In addition, a powder sintered portion is provided within the heat column.

The heat sink of the present disclosure has a one-piece-formed structure or a split structure.

In other features, the fixing structure and the central hole portion are welded together.

The electronic component in the present disclosure may be a LED, CPU, GPU, chipset, power semiconductor or circuit board with electronic components.

Relying on the great heat conductivity of the heat exchange element used, the present disclosure directly mounts the electronic component on the heat exchange element for quick heat conduction to the heat sink. The heat sink may adopt a finned structure or a finless channel structure. The finned structure could provide great heat dissipation effects by the heat exchange supported by air convection and radiation, while the finless structure realizes the quick heat exchange by the air flow in the air channels. Compared to the conventional heat dissipation modules, the heat dissipation module disclosed by the present disclosure could be directly applied to the electronic components with a power of 100 W or more, such as high-power LEDs, CPUs, GPUs, chipsets, power semiconductors or circuits with electronic components.

DETAILED DESCRIPTION

Figure 1:
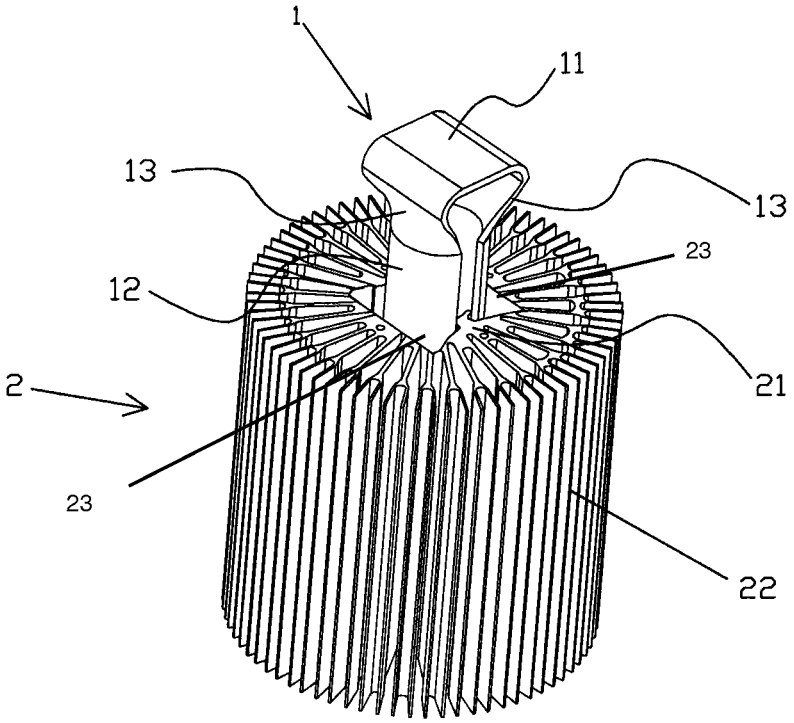
FIG. 1 is an exploded view of the first embodiment of the present disclosure.
Figure 2:
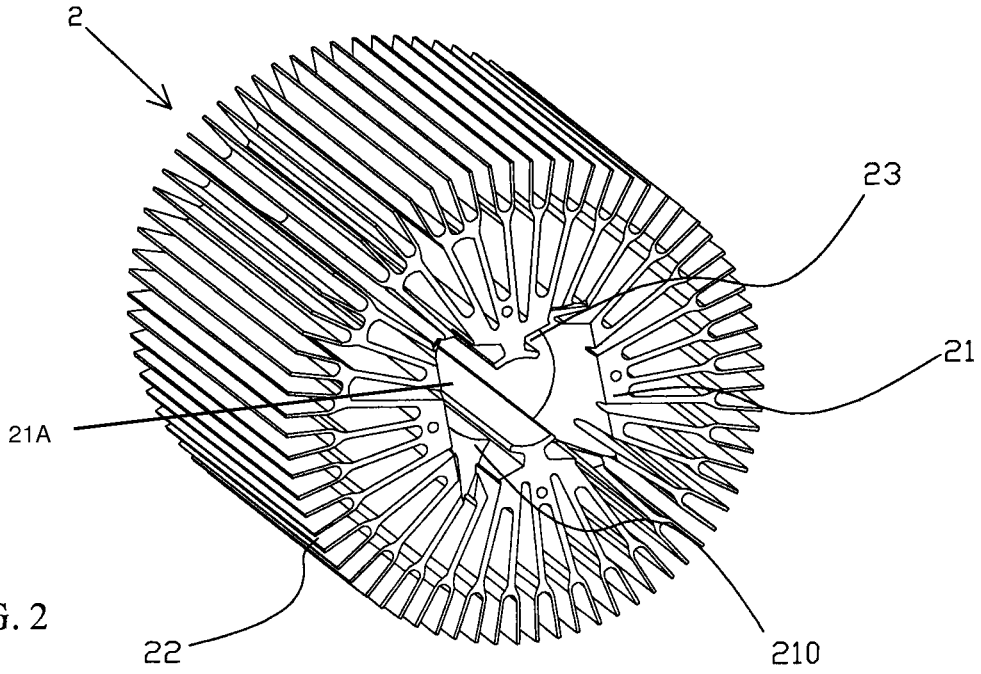
FIG. 2 is a schematic view of the heat sink in the first embodiment of the present disclosure.
Figure 3:
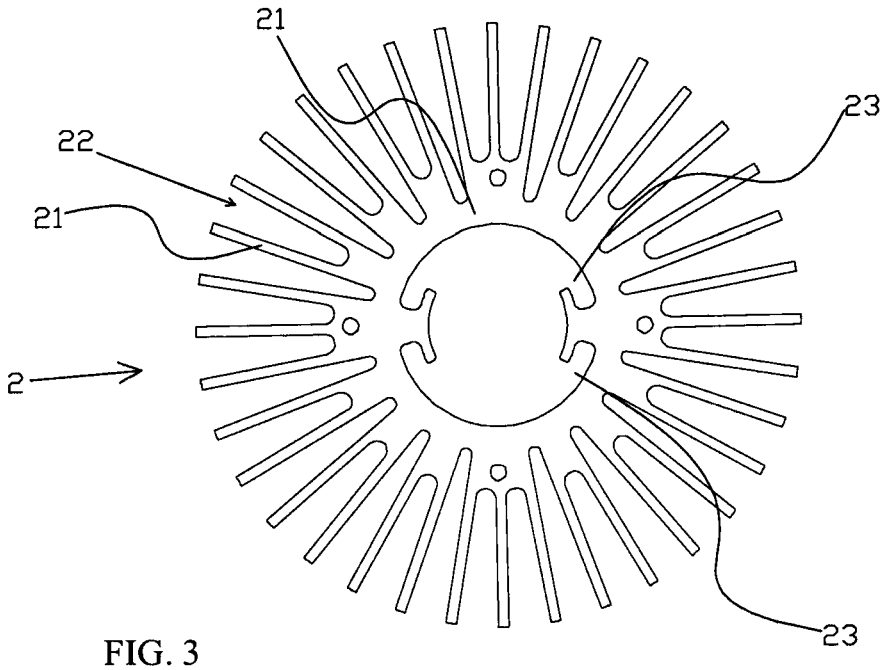
FIG. 3 is side view of the heat sink in the second embodiment of the present disclosure.

As shown by FIGS. 1 to 20, for cooling an electronic component 3, the present disclosure provides a high-power heat dissipation module, comprising a heat exchange element 1 and a heat sink 2.

The heat exchange element 1 is provided with a flat section 11 for mounting the electronic component 3, and a fixing structure 12 behind the flat section 11 for fixation. The heat exchange element 1 further has a sealed cavity 101, in which a working fluid is filled and a powder sintered portion 102 is attached to the inner wall thereof. As the working fluid within the heat exchange element 1 is gas-liquid two-phase changeable, it is vaporized at a hot surface to absorb heat, the resulting vapor is condensed at a cold surface to release the heat absorbed before, then the liquid is returned to the hot surface. The quick heat conduction is thus realized by this recirculation process.

The heat sink 2 has a central hole portion 21, for fixing the fixing structure 12 inserted so as to secure the entire heat exchange element 1, and as well to ensure that the end surface of the flat section 11 of the heat exchange element 1 fixed is slightly above the central hoe portion 21, whereby the flat section 11 is located on the end surface of the entire heat sink 2 for mounting the electronic component 3. Furthermore, a heat dissipation structure 22 is provided around the central hole portion 21, for heat exchange with the air surrounding.

In the present disclosure, both the heat exchange element 1 and heat sink 2 may have changes or modifications in practice, which will be elaborated in the following description of the embodiments.

Figure 16:
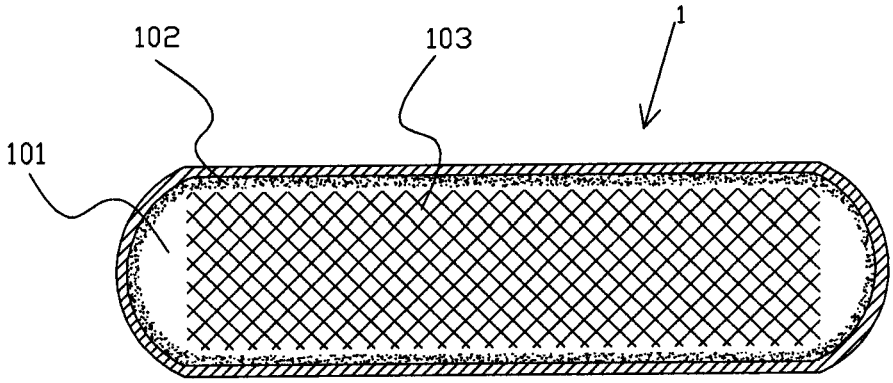
FIG. 16 is an internal view of the vapor chamber as the heat exchange element in the present disclosure.
Figure 17:
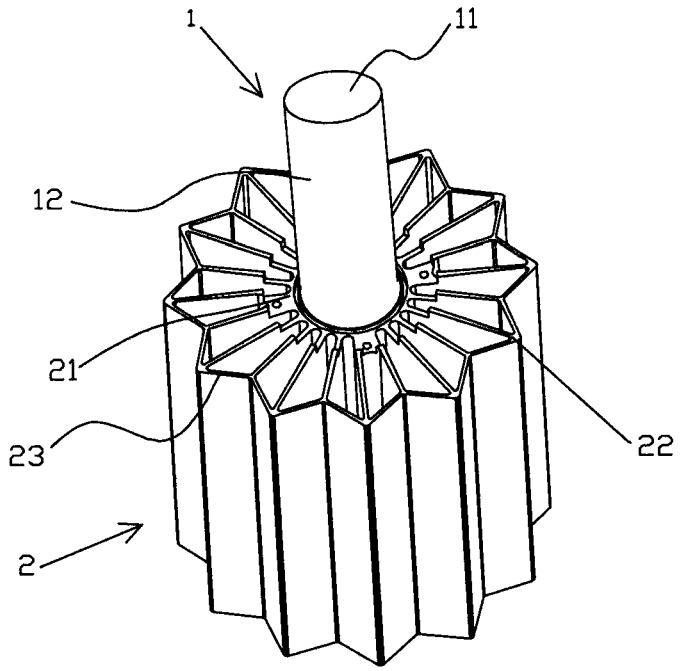
FIG. 17 is an exploded view of the heat dissipation module in the seventh embodiment of the present disclosure.

As shown by FIG. 1, in the first embodiment of the present disclosure, the heat exchange element 1 is a vapor chamber, with reference to FIG. 16, comprising a powder sintered portion 102 and a sealed cavity 101 filled with the working fluid, described as above. In addition, a supporting structure 103 could be added therein, for an overall strength enhancement for the vapor chamber. The middle of the vapor chamber is preserved as the flat section 11, and two vertical inserting sections formed by pressing are symmetrically disposed on the opposite sides of the flat section 11, namely these two inserting sections constitute the fixing structure 12. Accordingly, the heat dissipation device 2 has jacks 23, therein for receiving the inserting sections, namely the jacks 23, comprise the central hole portion 21. After inserted, the inserting sections is adhered to the inner wall of the jack-type central hole portion 21, whereby the heat generated by the electronic component 3 in work is transferred quickly from the inserting sections to the heat sink 2. As a preferred embodiment, surface-mount welding is used to enhance the connection between the inserting sections and the jacks 23, with this approach, first the welding paste is coated on the inserting sections or on the inner wall of the jacks, which are welded together by being heated in a heating furnace later. Furthermore, when heated in welding process the fixing structure 12 expands to fit on the inner wall of the central hole portion 21 tightly for better heat conductivity.

Figure 15:
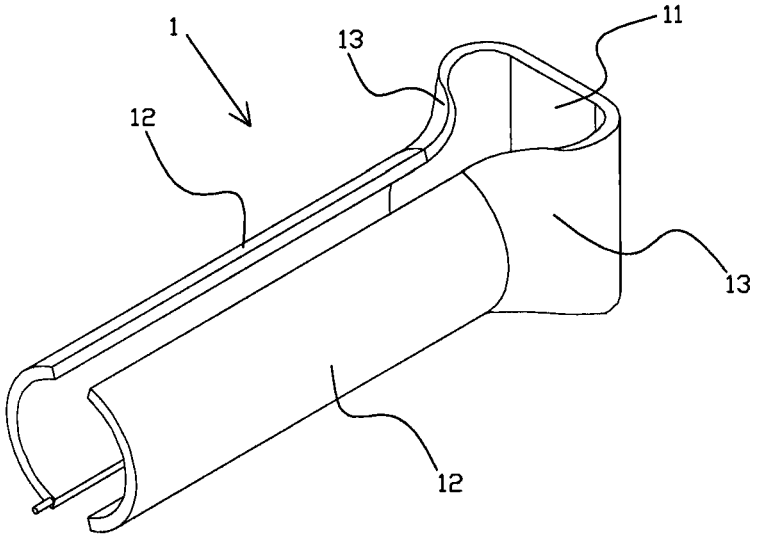
FIG. 15 is an exploded view of the vapor chamber used as the heat exchange element in the present disclosure.

As shown in FIG. 15, in a preferred embodiment the inserting sections (the fixing structure 12) on the two ends of the vapor-chamber-type heat exchange element 1 both have an outwards raised circular-arc-shaped cross section, together with the other to form a substantial circular tube. In general the two inserting sections do not touch each other, to separate the circular tube into two parts, a couple of gaps thus occur on the opposite sides of the circular tube, as shown by FIGS. 2, 3, 4 and 5. Accordingly, the jack-type central hole portion 21 of the heat sink 2 may be two arc-shaped holes matched with the shapes of the inserting sections, and preferably the two arc-shaped holes are connected and have arc-shaped transitional surfaces to prevent the heat generated by the electronic component 3 in work from accumulating on the central hole portion 21 of the heat sink 2, and the hollow portion could be used for cabling. Of course, in order to ensure that the vapor chamber fixed would not rotate or swing, the jacks may be connected partially; in other words, it is to ensure that the jacks have a positioning function.

In addition, in a preferred embodiment, the vapor chamber is embedded into the heat sink 2, to maximize the heat conductivity therein, thus a preferred embodiment for the present disclosure could be: between the flat section 11 and the two inserting sections 12 of the vapor chamber, two transitional section 13 convergent towards the axis of the heat exchange element 1 is provided to allow a larger diameter for the flat section 11 than the fixing structure 12. Furthermore for the convenience in pressing, the two transitional sections 13 could be designed into a gradually shrinking formation, namely, the portion of each transitional section close to the flat section 11 is wider than the portion close to the inserting section, and thus this formation could constitute a positioning structure for the heat sink 2. Correspondingly, as shown in the drawings, the heat sink 2 has a receiving chamber 210 on the end thereof close to the central hole portion 21, the receiving chamber 210 is matched with the combined shape of the two transitional sections in width, and the jacks of the central hole portion 21 are set on the bottom of the receiving chamber 210, thus in assembling the vapor chamber, the flat section 11 and two transitional sections 13 are contained by the receiving chamber 210, the inserting sections 12 are inserted into and fixed by the jacks, and the vapor chamber is positioned by the receiving chamber 201 as well.

In practice, an alternative embodiment could be: the jacks may be through holes extending from the bottom of the receiving chamber 210 of a finless heat sink 2 to the other end thereof, thereby forming though holes in the finless heat sink 2, by which the air surrounding could flow across the heat sink 2 for better heat dissipation effects. In addition, the flat section 11 slightly protrudes from the central hole portion 21, to provide gaps on the opposite sides of the flat section 11 for connecting the receiving chamber 210 and the jacks, for cabling as well as allowing air to pass through without barriers.

In this embodiment, the heat sink 2 is finned, wherein the heat dissipation structure 22 is a plurality of fins 221 distributed around the central hole portion 21. In detail, the fins 221 are arranged in a ring shape around the central hole portion 21, making the entire heat sink 2 tube-shaped, thus the outer finned heat dissipation structure 21 is in direct contact with air, dissipating heat through radiation. In the embodiment shown by FIG. 3, the fins 221 are flat-plate-shaped, distributed perpendicularly to the central hole portion 21, and provided with large contact area to air for better heat dissipating performance.

Figure 4:
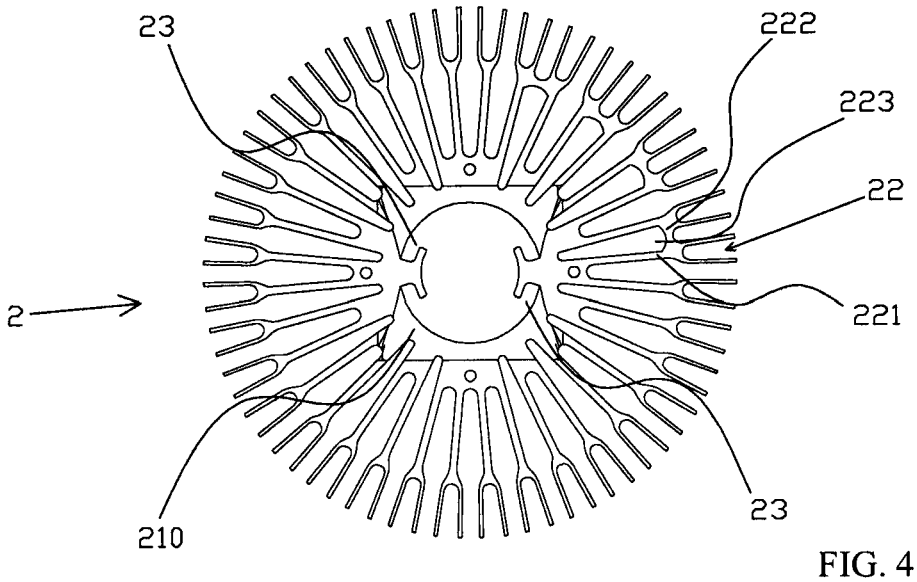
FIG. 4 is a side view of the heat sink in the first embodiment of the present disclosure.

Alternatively, as shown in FIG. 4, each fin 221 has a branched end, to enlarge the contact area with air for enhancing heat dissipation. In addition, a connecting wall 222 is provided between every two adjacent fins 221, a plurality of through holes 223 are thus defined by the connecting walls 222 and the corresponding fins 221, in which the air flows through to create air convection, consequently to create a chimney effect for better heat dissipation.

Figure 5:
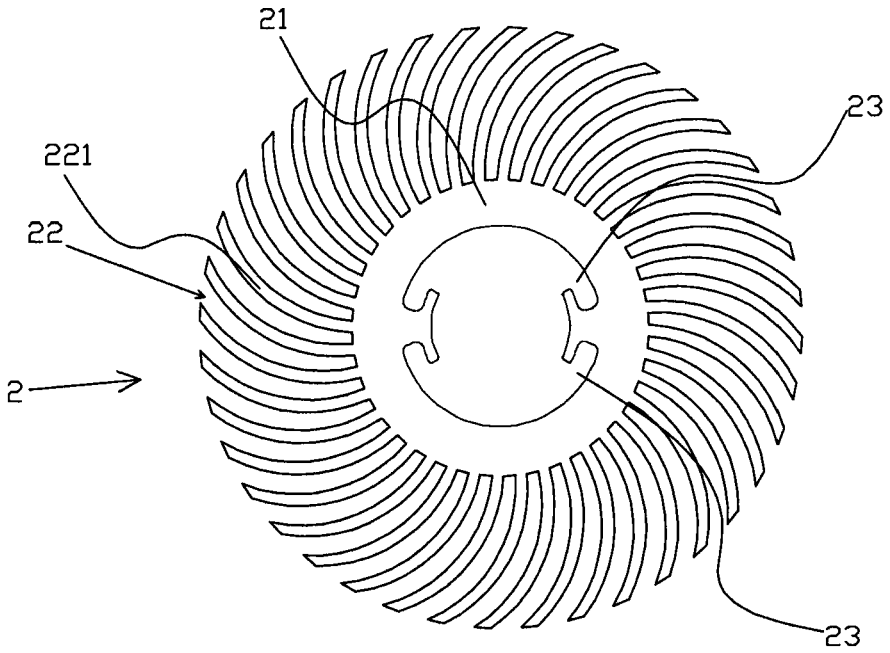
FIG. 5 is a side view of the heat sink in the third embodiment of the present disclosure.

In the third embodiment shown in FIG. 5, the fins 221 may also be arc-shaped with a same circumferentially bending direction, to force the air passing among the fins 221 to flow towards a same direction.

In the above embodiments, the heat sinks 2 involved all have a one-piece-formed metal structure. Of course, they could also have a split structure, assembled by several separated components, and made of for example aluminum, or other high conductivity materials.

Figure 6:
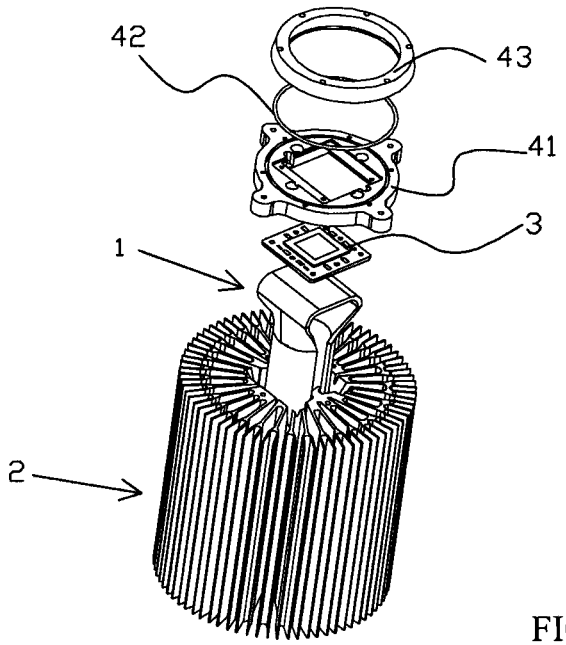
FIG. 6 is an exploded view of the heat dissipation module in the first embodiment of the present disclosure used for an electronic component.
Figure 7:
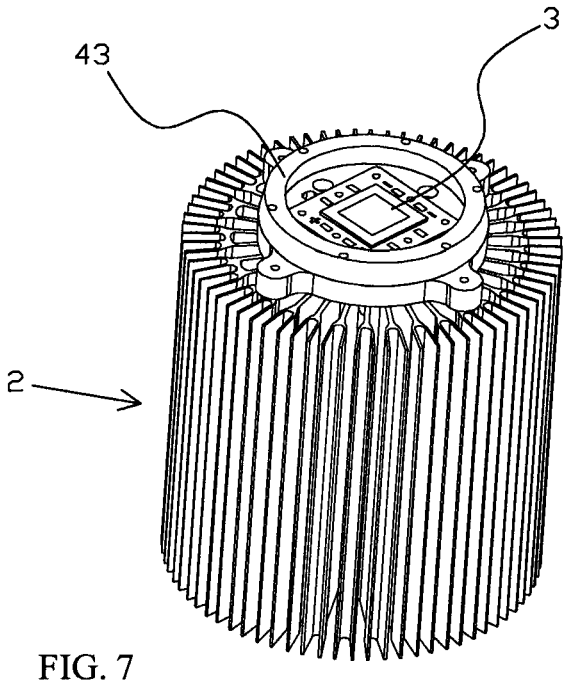
FIG. 7 is a schematic view of the heat dissipation module assembled in the first embodiment of the present disclosure used for an electronic component.
Figure 8:
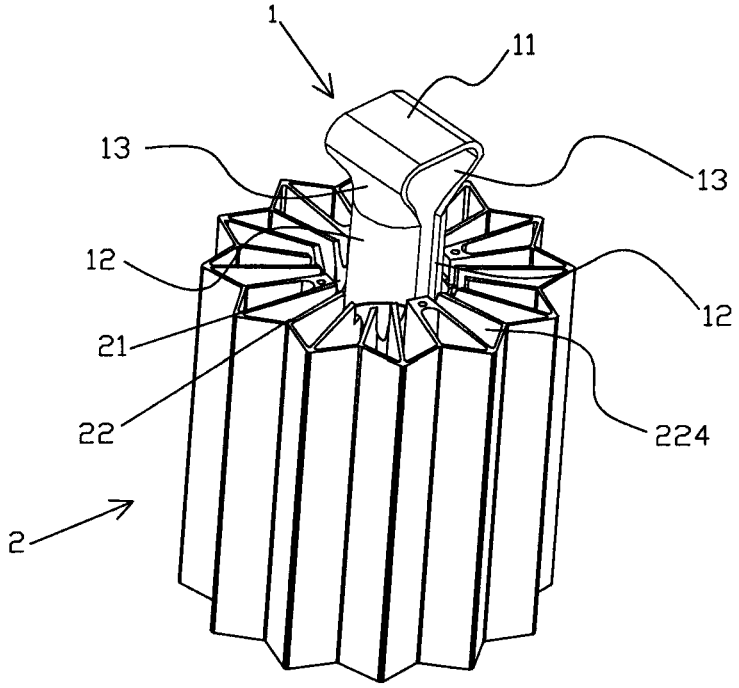
FIG. 8 is a exploded view of the heat dissipation module in the fourth embodiment of the present disclosure.

The electronic component 3 mentioned in the present disclosure may be LEDs, CPUs, GPUs (Graphic Processing Units), chipsets, power semiconductors or circuit boards with electronic components, which can be directly attached to the flat section 11, and fixed by a surface-mount manner. As shown by FIG. 6, in an application to LED, a covering plate 41 is provided and mounted around the electronic component 3 on the central hole portion 21 of the heat sink 2, wherein screws are used to fix the covering plate 41 on the finless heat sink 2. In addition, an upper cover 43 with sealing ring 42 is mounted thereon, cooperated with the covering plate 41 described above forming a sealed water-proof structure shown in FIG. 7.

Of course, besides the finned configuration described above, the heat sink 2 in the present disclosure may have a finless configuration instead.

As shown in FIGS. 8 to 12, a finless heat sink 2 also has a central hole portion 21, the heat dissipation structure 22 disposed around the central hole portion 21 consists of a plurality of air channels 224, which creates chimney effects. While the electronic component 3 is working, the heat generated by the electronic component 3 is conducted to the heat exchange element 1, and while the temperature difference between the heat exchange element 1 and the finless heat sink 2 is relatively large, the heat generated by the electronic component 3 is scattered to the finless heat sink 2 immediately, on the one hand a part of the heat is dispersed to the air in contact with the outer part of the finless sink 2 by radiation, on the other hand the rest of the heat is taken away by the air flows through the air channels 224 by air convection.

The finless heat sink 2 in this embodiment has a structure of air channel, the air channels 224 comprise the blades 225 disposed on the outer wall of the central hole portion 21, wherein each two adjacent blades 225 are connected on the outer ends thereof to form a closed formation, and in cooperation with the outer wall of the central hole portion 21, to form an air channel 224, thus, around the central hole portion 21, a plurality of blades 225 form a tube-like-shape, the air channels 224 are distributed evenly along the circumferential direction of the central hole portion 21, and all air channel 224 have a same direction to the axis of the central hole portion 21. In detail, on the central hole portion 21, an outer tube-like structure is formed by the outer walls 226 connecting the outer ends of the blades 225, in other words, it is formed by the blades 225 and the central hole portion 21.

Figure 9:
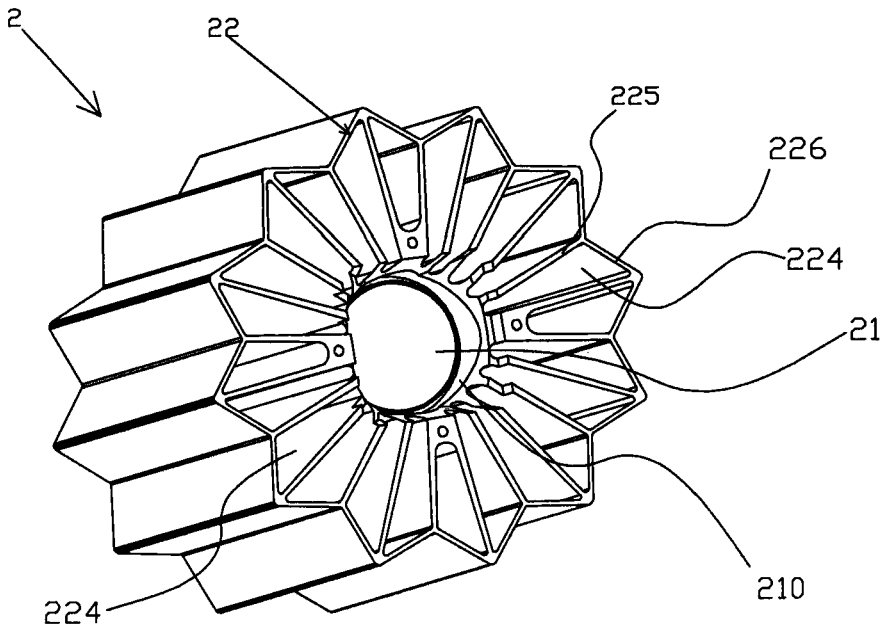
FIG. 9 is schematic view of the heat sink in the fourth embodiment of the present disclosure.
Figure 10:
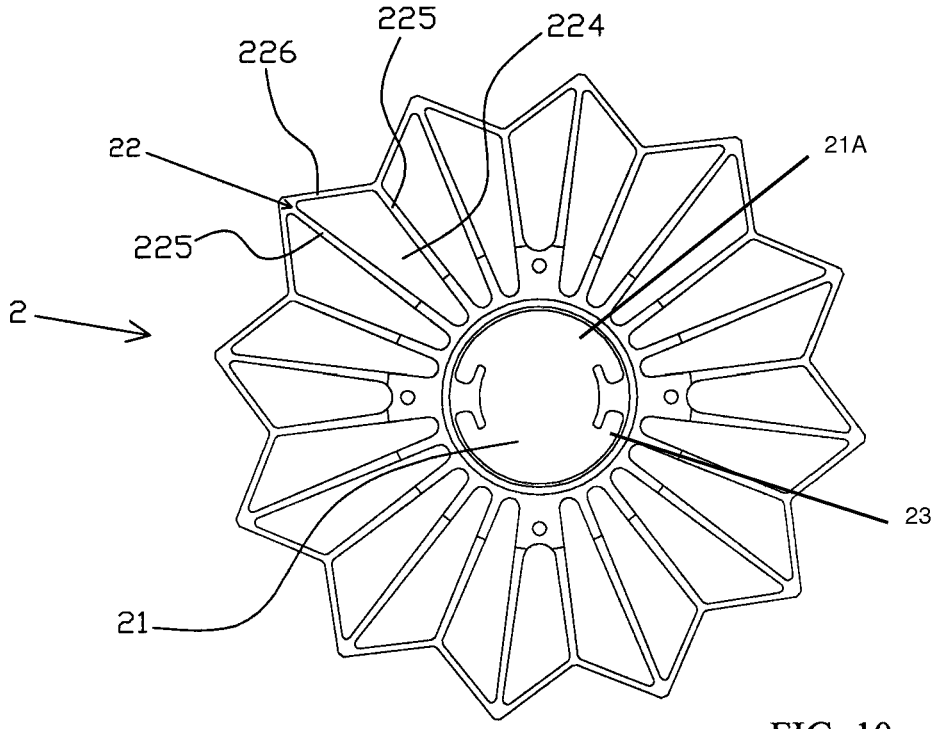
FIG. 10 is side view of the heat sink in the fourth embodiment of the present disclosure.

Several preferred embodiments of the air channel 224 are described as follows:

In the embodiment shown in FIGS. 9 and 10, the outer walls 226 are flat, the outer structure of the heat sink 2 is formed by the outer walls 226 connected in order, and have a polygonal tube shape with angularities, wherein each angularity comprises a blade 225 connected to the central hole portion 21, thus two adjacent blades 225 and one outer wall 226 form an air channel 224. In use of the structure described above, the outer walls 226 and blades 225 are both in contact with air, so as to radiate heat to the air surrounding, whereby the heat exchange is realized while air flows through the air channels 224.

Figure 11:
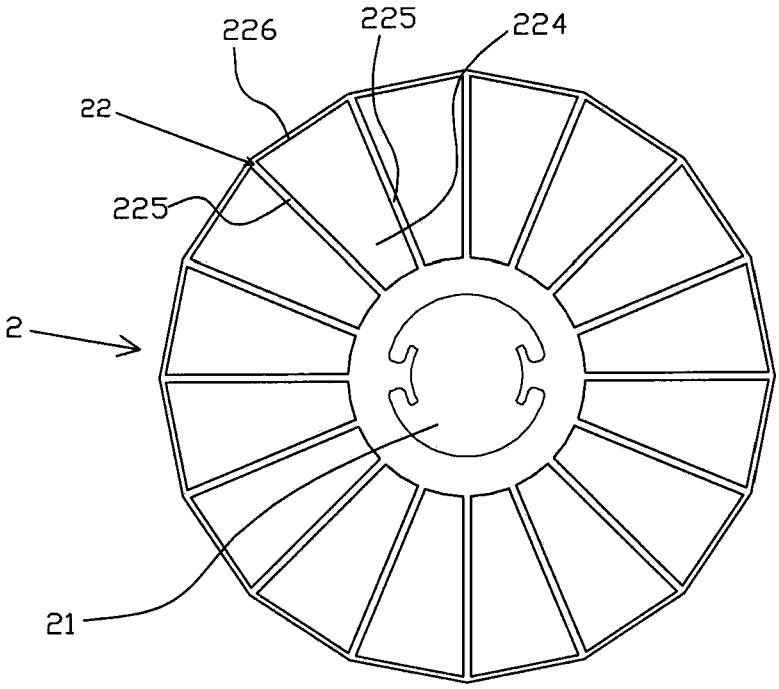
FIG. 11 is a side view of the heat sink in the fifth embodiment of the present disclosure.
Figure 12:
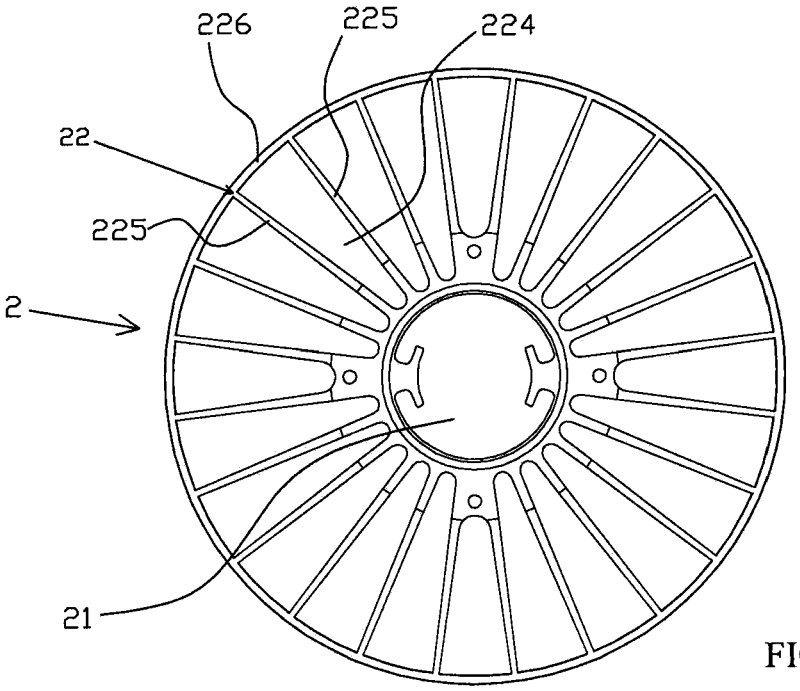
FIG. 12 is a side view of the heat sink in the sixth embodiment of the present disclosure.

In the embodiment shown in FIG. 11, the outer walls 226 are flat, the outer structure of the heat sink 2 is formed by the outer walls 226 connected in order, and have a polygonal tube shape. Compared to the last embodiment, the difference is that the present structure has no angularity, and in each corner of the outer structure a blade 225 is connected to the central hole portion 21, thus each two adjacent blades 225 and one outer wall 226 form an air channel 224. With this arrangement, the outer walls 226 and the blades 225 are both in contact with air, whereby the heat exchange is realized while air flows through the air channels 224, and a large heat dissipation area is ensured as well, to satisfy the heat dissipation requirements.

In the embodiment shown in FIG. 11, the outer walls 226 are arc-shaped, the outer structure has a circular tube shape formed by the outer walls 226 connected in order, with such an arrangement, the blades 225 are evenly distributed between the outer structure and the central hole portion 21 for connection. The outer walls 226 and the blades 225 are both in contact with air, whereby the heat exchange is realized while air flows through the air channels 224, and a large heat dissipation area is ensured as well, to satisfy the heat dissipation requirements.

In the aforementioned embodiments, the heat sink 2 involved all has a one-piece-formed metal structure, of course, the heat sink 2 could also have a split structure, assembled by several separated components, of which materials could be any metal materials with high conductivity, such as aluminum.

In the aforementioned embodiments, the heat exchange element 1 may be a vapor chamber, of which middle is processed into the flat section 11, and the two ends of the vapor chamber are processed into the inserting sections perpendicular to the flat section 11 by pressing, which are the fixing structure 12.

In the middle of the finless heat sink 2, jacks are provided as the central hole portion 21, for receiving the fixing structure 12. As shown by FIG. 15, two inserting sections (the fixing structure 12 in other words) are disposed on the two lateral sides of the vapor-chamber-type heat exchange element 1 respectively, the cross sections of the inserting sections are circular-arc-shaped and raised outwards, thus the two inserting sections together form a circular-tube-like shape, and usually these two inserting sections do not touch each other, to separate the circular tube into two parts, and thus two symmetrical gaps exist on the two lateral sides of the tube, as shown by FIGS. 8 to 12. Accordingly, the corresponding jack-type central hole portion 21 of the heat sink 2 are designed into two circular-arc-shaped holes matched with the shapes of the two inserting sections. The two circular-arc-shaped holes are connected with each, and have arc-shaped transitional surfaces to prevent the heat generated by the electronic component 3 in work from accumulating on the central hole portion 21 of the heat sink 2. In addition, the hollow portion could be used for cabling. Of course, in order to ensure that the vapor chamber fixed would not rotate or swing, the jacks may be connected partially, in other words, it is to ensure that the jacks have a positioning function as well.

For the finless heat sink 2, preferably, the vapor chamber is embedded into the heat sink 2 for better heat conduction, transitional sections 13 are provided between the flat section 11 and the inserting sections 12 disposed respectively on the two ends of the flat section 13, the transitional sections 13 converge towards the axis thereof for smoothly connecting the flat section 11 and the inserting sections 12, the transitional sections 13 have wider portions close to the flat section 11, the narrower portions near the inserting sections 12 could be used as a positioning structure. Accordingly, as shown by FIG. 9, the finless heat sink 2 has a receiving chamber 210 on the end thereof close to the central hole 21, the receiving chamber 210 is matched with the combined shape of the two transitional sections 13 in width, and the openings of the jacks of the central hole portion 21 are set on the bottom of the receiving chamber 210. In assembling the vapor chamber, the flat section 11 and the two transitional sections 13 are contained in the receiving chamber 210, the fixing structure 12 is inserted into the jacks across the receiving chamber 210 and so secured, and the two transitional sections 13 are therefore positioned by the receiving chamber 210 as well. In practice, a preferred alternative solution could be: the jacks are through holes extending from the bottom of the receiving chamber 210 to the other end of the heat sink 2, whereby the finless heat sink 2 has a through hole to allow air to flow across the heat sink 2 for better cooling effects. In addition, as the end surface of the flat section 11 is slightly higher than the end surface of the central portion 21, gaps are provided beside the flat section 11 to connect the receiving chamber 210 and the jacks for cabling.

Figure 13:
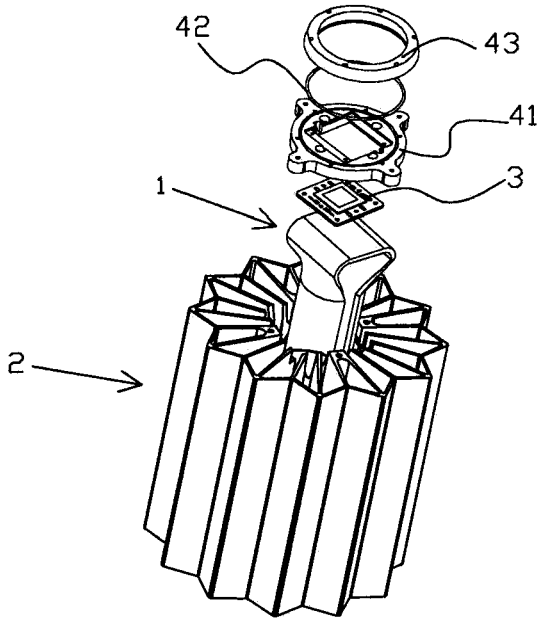
FIG. 13 is exploded view of heat dissipation module in the fourth embodiment of the present disclosure used for an electronic component.
Figure 14:
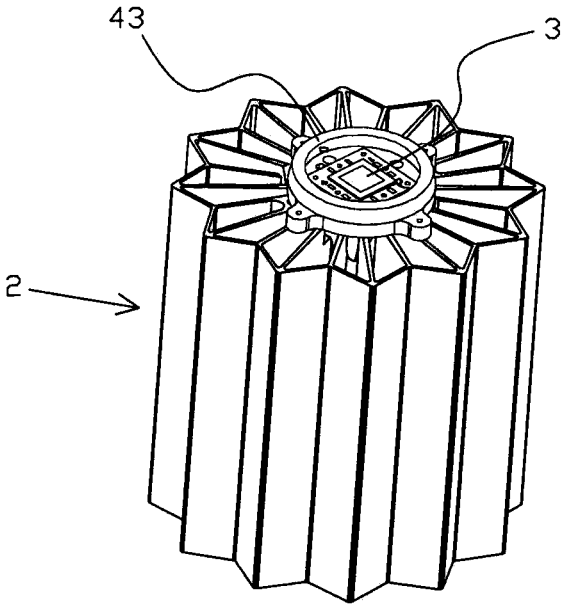
FIG. 14 is a schematic view of the heat dissipation module assembled in the fourth embodiment of the present disclosure used for an electronic component.

The combination of the finless heat sink and the vapor chamber is shown by FIGS. 13 and 14.

Figure 18:
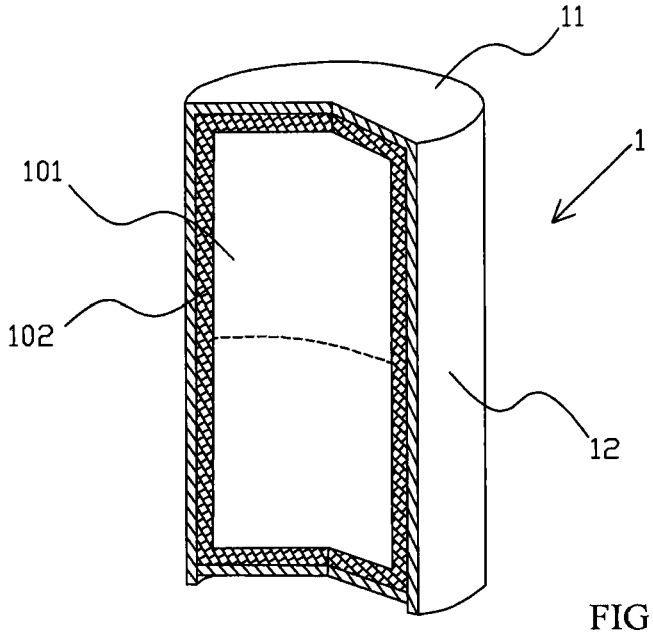
FIG. 18 is an internal view of the heat column used as the heat exchange element in the present disclosure.

Besides the vapor chamber described in above embodiments, a heat column could be used as the heat exchange element 1 in the present disclosure. The heat-column-type heat exchange element 1 is cylinder-shaped, one end surface of the cylinder is as the flat section 11, and the cylinder part is as the fixing structure 12, as shown in FIG. 18. Similarly to the vapor chamber, the heat column has a powder sintered portion 102 and a sealed cavity 101 for containing the working fluid, realizing heat conduction by gas-liquid two-phase changing. Due to the size of the heat column, the powder sintered portion 102 can be attached to the inner wall of the cavity 101, and a half space of the cavity 101 is for working fluid and the other half is vacuumed. Accordingly, the central hole portion 21 of the heat sink 2 could be a inserting hole corresponding to the cylinder-shaped fixing structure 12, and for better fixing effects, surface-mount welding is adopted. In detail, coating the welding paste on the column and the hole, and putting the parts into a heating furnace for welding them together. With this approach, as expanding when heated in the heating process the fixing structure 12 could be fitted in with the inner wall of the central hole portion 21 of the finless heat sink 2 tightly for better heat conductivity.

Figure 19:
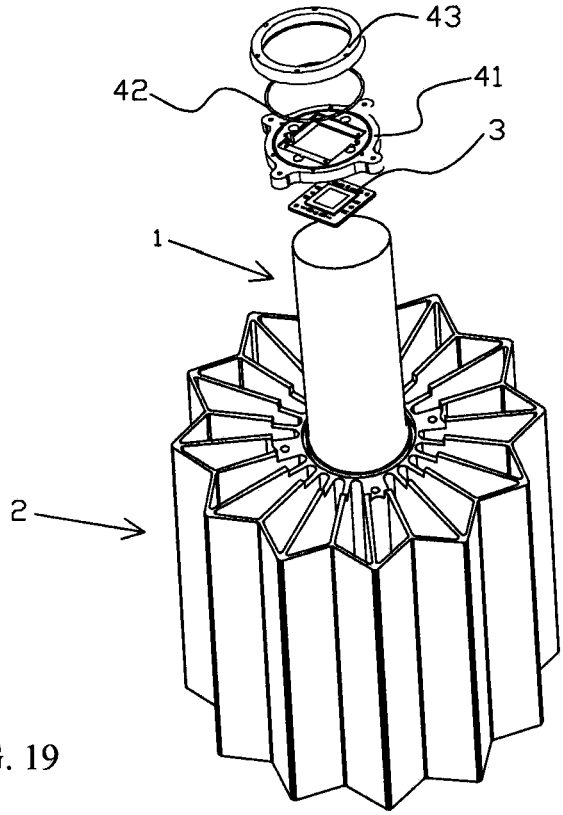
FIG. 19 is an exploded view of the heat dissipation module in the seventh embodiment of the present disclosure.
Figure 20:
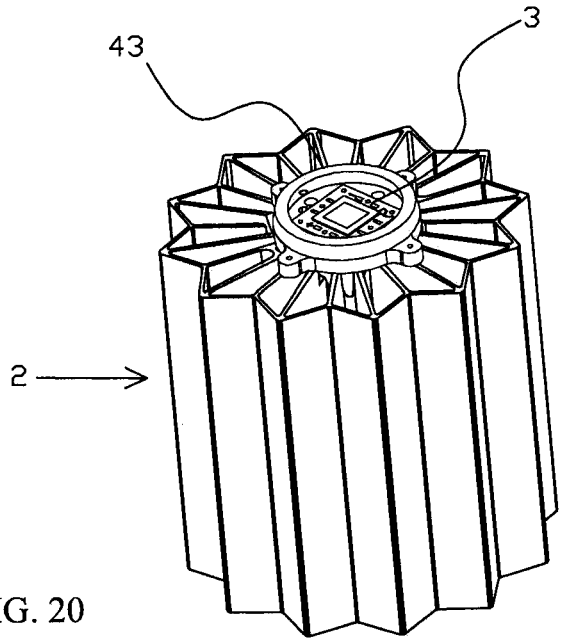
FIG. 20 is a schematic view of the heat dissipation module assembled in the seventh embodiment of the present disclosure used for electronic component.

This embodiment is more convenient for assembly compared to others, as shown by FIGS. 19 and 20, the electronic component 3 could be directly mounted on the flat section 11 and fixed by a surface-mount manner. In the embodiment to LED chips, a covering plate 41 is provided and mounted around the electronic component 3 on the central hole portion 21 of the finless heat sink 2, screws are used to secure the covering plate 41. Furthermore, an upper cover 43 with a lens is provided and mounted above the covering plate 41, cooperated with a sealing ring 42 to form a sealed water-proof structure.

The experiment verifies that adopting the technology disclosed by the present disclosure is able to reduce the working temperature by 10 degree and more for the electronic components; the heat dissipation performance of the heat dissipation module disclosed by the present disclosure is thus demonstrated.

Of course, for some electronic components, the present disclosure can still be used with fans or other cooling instruments, i.e., mounting a fan or other cooling instruments on the other end of the heat sink 2 provided by the present disclosure (not shown in accompanying drawings), to dramatically enhance the heat dissipation efficiency.

The present disclosure is an improvement to the structure of the conventional heat dissipation modules, cooperated with a vapor chamber having a specified shape, the present disclosure also adopts vapor chamber to secure the electronic component and transfer heat. Compared to the conventional heat dissipation modules, the present disclosure could handle the heat dissipation task for the electronic components with a power of more than 100 Watts. The performance of the heat dissipation module provided by the present disclosure could be further improved if used in cooperation with fans.

While the disclosure has been described in terms of what are presently considered to be the most practical and preferred embodiments, it is to be understood that the disclosure need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed:

1. A heat dissipation module for cooling an electronic component, comprising:

a vapor chamber having:

a sealed cavity, a powder sintered portion and a gas-liquid two-phase change working fluid within said sealed cavity, a flat section for mounting the electronic component, two press-formed inserting sections, each inserting section being symmetrically disposed on ends of the flat section, and two transitional sections, each transitional section connecting said flat section to a corresponding inserting section, said flat section, the inserting sections, and the two transitional sections being made integral and having a unitary configuration; and a heat sink having a central hole portion, a plurality of fins arranged around said central hole portion, each fin extending radially outward from said central hole portion, and a plurality of air channel portions disposed around said central hole portion, wherein said central hole portion comprises a receiving chamber, the transitional sections and the inserting sections of said vapor chamber engaging said receiving chamber, wherein each air channel portion is comprised of a set of said plurality of fins extending radially outward from said central hole portion to an outer wall, said at least one air channel being defined by two adjacent fins of said set of said plurality of fins and said outer wall, wherein each outer wall of each air channel portion is separate from an outer wall of an adjacent air channel portion, wherein said receiving chamber is comprised of a pair of jacks cooperative with the two inserting sections, each inserting section engaging a corresponding jack, wherein each jack has an arc shaped surface in contact with corresponding fins and a corresponding inserting section, each corresponding fin extending radially outward from said arc shaped surface, each arc shaped surface having said corresponding fins radially extending outward from the arc shaped surface on both sides of a center of the arc shaped surface, wherein at least one arc shaped surface has said plurality of air channels radially extending outward from the arc shaped surface, wherein each inserting section has a complementary arc shaped support for flush engagement to the arc shaped surface of the corresponding jack, the two inserting sections forming a hollow tube configuration with two symmetrical gaps, wherein said flat section has flat edges, wherein the inserting sections have curved edges corresponding to said hollow tube configuration, wherein each transitional section forms an orthogonal connection at a respective flat edge of said flat section and has rounded connection at a respective curved edge of a corresponding inserting section, said corresponding inserting section being orthogonal to said flat section, and wherein heat generated by the electronic component conducted to each complementary arc shaped support of each inserting section dissipates equally through the corresponding fins extending radially from said arc shaped surface of the corresponding jack and through said plurality of air channels.

2. The heat dissipation module according to claim 1, wherein the jacks are connected partially.

3. The heat dissipation module according to claim 2, wherein each jack has an arc-shaped transitional surface corresponding to a respective transition section of said vapor chamber.

4. The heat dissipation module according to claim 1, wherein the fins are arranged in a ring centered on said central hole portion.

5. The heat dissipation module according to claim 4, wherein the fins are flat plates.

6. The heat dissipation module according to claim 5, wherein the corresponding fins have branched terminal ends opposite said central hole portion, and wherein each set of fins of said air channel portion have branched terminal ends opposite said central hole portion.

7. The heat dissipation module according to claim 1, wherein the vapor chamber comprises a supporting structure within the sealed cavity.

8. The heat dissipation module according to claim 1, wherein the electronic component consists of at least one of a group consisting of: a LED, CPU, GPU, chipset, power semiconductor and a circuit board.

9. The heat dissipation module according to claim 1, wherein the inserting sections and the jacks are welded together.

10. The heat dissipation module according to claim 1, wherein the jacks extend from the receiving chamber to the other end of the central hole portion.

11. The heat dissipation module according to claim 1, wherein said flat section protrudes from an end surface of said central hole portion, and wherein gaps between lateral sides of said flat section and said central hole portion connect a portion of said receiving chamber corresponding to each transition section to the two jacks.

* * * * *